US006660442B2

(12) United States Patent
Sata et al.

(10) Patent No.: US 6,660,442 B2
(45) Date of Patent: Dec. 9, 2003

(54) NONMAGNETIC BLACK TONER FOR REVERSAL DEVELOPMENT

(75) Inventors: Shinichi Sata, Wakayama (JP); Akihiro Eida, Wakayama (JP); Koji Shimokusa, Wakayama (JP); Jun Shimizu, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/114,262

(22) Filed: Apr. 3, 2002

(65) Prior Publication Data

US 2002/0177059 A1 Nov. 28, 2002

(30) Foreign Application Priority Data

Apr. 3, 2001 (JP) ..... 2001-105018

(51) Int. Cl.[7] ..... G03G 13/06
(52) U.S. Cl. ..... 430/100; 430/108.6
(58) Field of Search ..... 430/108.6, 100, 430/109.4, 111.4

(56) References Cited

U.S. PATENT DOCUMENTS 5,536,614 A * 7/1996 Kondo et al. ..... 430/137
6,130,017 A 10/2000 Hayashi et al.

FOREIGN PATENT DOCUMENTS

| | | |
|---|---|---|
| JP | A-7-104503 | 4/1995 |
| JP | A-7-271087 | 10/1995 |
| JP | A-9-25126 | 1/1997 |
| JP | A-2000-10344 | 1/2000 |

* cited by examiner

*Primary Examiner*—John Goodrow
(74) *Attorney, Agent, or Firm*—Birch, Stewart, Kolasch & Birch, LLP

(57) ABSTRACT

A nonmagnetic black toner for reversal development comprising a resin binder; and a black colorant comprising a composite oxide of two or more metals, the composite oxide having an oil absorption per unit area of 0.07 ml/m$^2$ or less. The nonmagnetic black toner can be suitably used for the development of a latent image formed in electrophotography, electrostatic recording method, electrostatic printing method or the like.

8 Claims, No Drawings

NONMAGNETIC BLACK TONER FOR REVERSAL DEVELOPMENT

BACKGROUND OF THE INVENTION

1. Field of the Invention

The present invention relates to a nonmagnetic black toner for reversal development used for the development of a latent image formed in electrophotography, electrostatic recording method, electrostatic printing method or the like.

2. Discussion of the Related Art

Conventionally, carbon blacks have been used as a black colorant for a toner. However, the carbon blacks have some defects such that the volume specific resistance is low, so that triboelectric charges required for development cannot be maintained, whereby a sufficient degree of blackness cannot be obtained. In addition, there are also pointed out some problems in safety hygiene. Therefore, various composite oxides have been proposed as black colorants used in place of carbon black (Japanese Patent Laid-Open No. 2000-10344 (U.S. Pat. No. 6,130,017) and Japanese Patent Laid-Open No. Hei 9-25126.

On the other hand, recently, similar to the widespread trends in plain paper copy machines (PPC), there has been a remarkable progress in laser beam printers (LBP). In the case of the PPC, the development is carried out by forming an electrostatic latent image carrying electric charges on a photoconductor, and changing its surface potential by the intensity of the light source, thereby changing the image tone (charged area development). By contrast, in the case of LBP, since a latent image not having electric charges is formed by two-step of on-and-off, the area coverage modulation by the number of halftones is carried out (discharged area development, i.e. reversal development). Therefore, in the reversal development, the transferability of fine halftones affects the clearness, so that an improvement in image transferability is especially desired.

Conventionally, proposals for improving the image transferability, including a toner in which its wettability is adjusted by an amount of a wax or the like (Japanese Patent Laid-Open No. Hei 7-104503), a toner in which a silica having a large size is added (Japanese Patent Laid-Open No. Hei 7-271087), and the like, have been made. However, these toners have some defects such that filming of the toner is likely to take place in the former toner, and that the silica is embedded in the toner, so that its durability tends to be lowered in the latter toner.

An object of the present invention is to provide a nonmagnetic black toner for reversal development, comprising a black colorant useful for reversal development, namely a nonmagnetic black toner for reversal development for performing area coverage modulation by halftone, which has a sufficient high degree of blackness, a high volume-specific resistance, and excellent image transferability.

These and other objects of the present invention will be apparent from the following description.

SUMMARY OF THE INVENTION

According to the present invention, there is provided a nonmagnetic black toner for reversal development comprising:

a resin binder; and a black colorant comprising a composite oxide of two or more metals, the composite oxide having an oil absorption per unit area of 0.07 ml/m$^2$ or less.

DETAILED DESCRIPTION OF THE INVENTION

One of the greatest features of the toner of the present invention resides in that the toner comprises a black colorant comprising a composite oxide of two or more metals, the composite oxide having a specified oil absorption. By adjusting the oil absorption of the composite oxide, the affinity of the composite oxide with the resin binder is adjusted, whereby the dispersibility of the composite oxide can be increased. By the improvement in the dispersibility of the composite oxide, the toner can be made into a smaller size, and the transferability of the toner is improved together with the uniform chargeability and the stability with the passage of time. Therefore, the composite oxide has an oil absorption per unit area of 0.07 ml/m$^2$ or less, preferably from 0.0001 to 0.05 ml/m$^2$, more preferably from 0.001 to 0.02 ml/m$^2$. In the present invention, the above-mentioned oil absorption (ml/m$^2$) is calculated by the following equation using the oil absorption (ml/100 g) as determined by the method according to JIS K5101 and the specific surface area (m$^2$/100 g):

$$\text{Oil Absorption Per Unit Area } (\text{ml/m}^2) = \frac{\text{Oil Absorption } (\text{ml/100 g})}{\text{Specific Surface Area } (\text{m}^2/100\text{ g})}$$

The oil absorption of the composite oxide, which may be dependent on its composition, is especially greatly dependent on its particle size. When the specific surface area becomes larger by making the particle size smaller, the oil-absorption also becomes larger. On the other hand, when the specific surface area becomes smaller by making the particle size larger, the oil-absorption also becomes smaller. In addition, the oil absorption can be increased by utilizing capillary phenomenon by the secondary aggregation.

The composite oxide has an average particle size of preferably from 5 nm to 1 $\mu$m, more preferably from 5 to 500 nm, especially preferably from 5 to 200 nm, from the viewpoints of the oil absorption and the covering strength.

In the present invention, the composite oxide is constituted by at least 2 metals, preferably at least 3 metals, from the viewpoint of the degree of blackness of the toner. Especially, it is preferable that at least one, preferably at least two, more preferably at least three of the metals of the composite oxide belongs to Group 2 or 13 of the Third Period of the Periodic Table, or to Groups 3 to 11 of the Fourth Period of the Periodic Table. Magnesium (Mg) and aluminum (Al) belong to Group 2 or 13 of the Third Period of the Periodic Table, and scandium (Sc), titanium (Ti), vanadium (V), chromium (Cr), manganese (Mn), iron (Fe), cobalt (Co), nickel (Ni) and copper (Cu) belong to Groups 3 to 11 of the Fourth Period of the Periodic Table. Among them, Mg, Al, Ti, Mn, Fe and Cu are preferable, and Mg, Al, Mn, Fe and Cu are especially preferable. The compositional ratio of the metals in the composite oxide is not particularly limited.

The content of the composite oxide is preferably from 4 to 30% by weight, more preferably from 4 to 20% by weight, especially preferably from 7 to 15% by weight, of the toner, from the viewpoints of the degree of blackness and the specific gravity of the toner.

The process for preparing a composite oxide includes a process comprising depositing other oxide on a surface of the main oxide used as a core particle (Japanese Patent Laid-Open No. 2000-10344 (U.S. Pat. No. 6,130,017)), a process of making a composite oxide comprising sintering several oxides (Japanese Patent Laid-Open No. Hei 9-25126), and the like, without being particularly limited thereto.

The preferable commercially available composite oxide in the present invention includes "Dye Pyroxide Black No. 1," "Dye Pyroxide Black No. 2" (hereinabove commercially available from DAINICHISEIKA COLOR & CHEMICALS MFG. CO., LTD.), "HSB-603Rx," "HSB-605" (hereinabove commercially available from Toda Kogyo Corp.), "ETB-100" (commercially available from Titan Kogyo K.K.), MC Series (commercially available from MITSUI MINING & SMELTING CO., LTD.), and the like.

The toner of the present invention may contain a known colorant other than the above-mentioned composite oxide as a colorant, but it is preferable that carbon black is not contained.

The resin binder in the present invention includes polyesters, hybrid resins which are defined below, styrene-acrylic resins, epoxy resins, polycarbonates, polyurethanes, and the like, without being particularly limited thereto. Among them, from the viewpoints of the dispersibility and the transferability of the colorant, the polyester and the hybrid resin are preferable, and the polyester is more preferable. The content of the polyester or the hybrid resin is preferably from 50 to 100% by weight, more preferably from 80 to 100% by weight, especially preferably 100% by weight, of the resin binder.

The term "hybrid resin" as referred to herein is a resin in which a condensation polymerization resin component, such as a polyester, is partially chemically bonded with an addition polymerization resin component such as a vinyl resin. The hybrid resin may be obtained by using two or more resins as raw materials, or it may be obtained by using one resin and raw material monomers of the other resin. Further, the hybrid resin may be obtained from a mixture of raw material monomers of two or more resins. In order to efficiently obtain a hybrid resin, those obtained from a mixture of raw material monomers of two or more resins are preferable.

The raw material monomer for the polyester includes dihydric or higher polyhydric alcohols and dicarboxylic or higher polycarboxylic acid compounds.

The dihydric alcohol includes, for instance, alkylene oxide adducts of bisphenol A such as polyoxypropylene(2,2)-2,2-bis(4-hydroxyphenyl)propane and polyoxyethylene (2,2)-2,2-bis(4-hydroxyphenyl)propane, ethylene glycol, 1,2-propylene glycol, 1,4-butanediol, neopentyl glycol, polyethylene glycol, polypropylene glycol, bisphenol A, hydrogenated bisphenol A, and the like.

The trihydric or higher polyhydric alcohol includes, for instance, sorbitol, pentaerythritol, glycerol, trimethylolpropane, and the like.

In addition, the dicarboxylic acid compound includes, for instance, dicarboxylic acids such as maleic acid, fumaric acid, phthalic acid, isophthalic acid, terephthalic acid, adipic acid, and succinic acid; a substituted succinic acid of which substituent is an alkyl group having 1 to 20 carbon atoms or an alkenyl group having 2 to 20 carbon atoms, such as tetrapropenylsuccinic acid, n-dodecenylsuccinic acid, isododecenylsuccinic acid, n-dodecylsuccinic acid, isooctenylsuccinic acid and isooctylsuccinic acid; acid anhydrides thereof or lower alkyl(1 to 3 carbon atoms) esters thereof; and the like.

The tricarboxylic or higher polycarboxylic acid compound includes, for instance, 1,2,4-benzenetricarboxylic acid (trimellitic acid), 2,5,7-naphthalenetricarboxylic acid, pyromellitic acid, acid anhydrides, lower alkyl(1 to 3 carbon atoms) esters thereof, and the like.

The polyester can be prepared by, for instance, polycondensation of an alcoholic component, a carboxylic acid compound and the like at a temperature of 180° to 250° C. in an inert gas atmosphere in the presence of an esterification catalyst as desired.

It is desired that the polyester has an acid value of from 0.5 to 60 mg KOH/g, from the viewpoint of the dispersibility and the transferability of the colorant, and that the polyester has a hydroxyl value of from 1 to 60 mg KOH/g.

In addition, the polyester has a softening point of 80° to 165° C., and a glass transition point of 50° to 85° C.

The toner of the present invention may appropriately contain, in addition to the resin binder and the colorant, an additive such as a charge control agent, a fluidity improver, a releasing agent, an electric conductivity modifier, an extender, a reinforcing filler such as a fibrous substance, an antioxidant, an anti-aging agent, and a cleanability improver.

The toner of the present invention can be prepared by any of conventionally known methods such as kneading and pulverization method, polymerization method, emulsion and phase inversion method. Concretely, in a case of a pulverized toner prepared by kneading and pulverization method, for instance, the method comprises homogeneously mixing a resin binder, a colorant, and the like in a mixer such as a Henschel mixer or a ball-mill, thereafter melt-kneading with a closed kneader or a single-screw or twin-screw extruder, cooling, pulverizing and classifying the product. The volume-average particle size of the toner is preferably from 3 to 15 $\mu$m. Further, a fluidity improver such as hydrophobic silica or the like may be added to the surface of the toner as an external additive as occasion demands.

The nonmagnetic black toner of the present invention can be made into a small size by the improvement in the dispersibility of the composite oxide, and the transferability of the toner is improved together with the uniform chargeability and the stability with the passage of time, so that the transferring of fine halftones can be facilitated, thereby making it highly useful as a toner for reversal development. Since the triboelectric charges can be stably maintained, the toner can be also preferably used in the nonmagnetic monocomponent development. In the present invention, the term "nonmagnetic toner" refers to a paramagnetic material, a diamagnetic material, or a ferromagnetic material having a saturation magnetization of 10 $Am^2/kg$ or less, preferably 2.5 $Am^2/kg$ or less.

Further, the nonmagnetic black toner for reversal development of the present invention is similar to the resistance of colorants such as yellow, cyan and magenta, the nonmagnetic black toner can be suitably used in the formation of full-color fixed images.

Furthermore, the present invention provides a process for development of a toner, comprising applying the nonmagnetic black toner of the present invention to a development device for reversal development. In this process, it is preferable that the development device is a device for nonmagnetic monocomponent development, or a device for full-color development.

EXAMPLES

[Average Particle Size of Composite Oxide]

The number-average particle size is determined by measuring from an micrograph.

[Oil Absorption (ml/100 g) of Composite Oxide]

The oil absorption of linseed oil absorbed is determined by a method according to JIS K 5101.

[Specific Surface Area ($m^2$/100 g) of Composite Oxide]

The specific surface area is determined by the nitrogen adsorption method (BET method).

[Acid Value and Hydroxyl Value of Resin]

The acid value and the hydroxyl value are determined by a method according to JIS K 0070.

[Grass Transition Point of Resin]

The grass transition point is determined using a differential scanning calorimeter "DSC Model 210" (commercially available from Seiko Instruments, Inc.) with raising the temperature at a rate of 10° C./min.

[Weight-Average Molecular Weight of Resin]

The weight percentage of component soluble to tetrahydrofuran (THF) is determined as the weight-average molecular weight by the GPC Method (column: GMHLX+G3000HXL (commercially available from Tosoh Corporation), standard sample: monodispersed polystyrene, solvent: THF).

Resin Preparation Example 1

The amount 714 g of a propylene oxide adduct of bisphenol A (average number of moles added: 2.2 moles), 663 g of an ethylene oxide adduct of bisphenol A (average number of moles added: 2.2 moles), 518 g of isophthalic acid, 70 g of isooctenylsuccinic acid, 80 g of trimellitic acid and 2 g of dibutyltin oxide were reacted at 210° C. under a nitrogen gas stream with stirring. The polymerization degree was monitored by the softening point determined according to ASTM E28-51T, and the reaction was terminated when the softening point reached 130° C. The resulting resin is referred to as "Resin A." Resin A was a pale yellow solid and had a grass transition point of 65° C. In addition, Resin A had an acid value of 18 mg KOH/g and a hydroxyl value of 35 mg KOH/g.

Resin Preparation Example 2

The amount 12250 g of a propylene oxide adduct of bisphenol A (average number of moles added: 2.2 moles), 21125 g of an ethylene oxide adduct of bisphenol A (average number of moles added: 2.0 moles), 14940 g of terephthalic acid and 15 g of dibutyltin oxide were reacted at 230° C. under a nitrogen gas stream with stirring. The polymerization degree was monitored by the softening point determined according to ASTM E28-67, and the reaction was terminated when the softening point reached 121° C. The resulting resin is referred to as "Resin B." Resin B had a grass transition point of 66° C., an acid value of 3.44 mg KOH/g and a hydroxy value of 23.4 mg KOH/g.

Example 1

The amount 7000 g of Resin A, 700 g of a colorant "Dye Pyroxide Black No. 2" (commercially available from DAINICHISEIKA COLOR & CHEMICALS MFG. CO., LTD.), 70 g of a polypropylene wax "NP-055" (commercially available from Mitsubishi Chemical Corporation) and 70 g of a charge control agent "BONTRON S-34" (commercially available from Orient Chemical Co., Ltd.) were supplied into a Henschel Mixer, and mixed with stirring at a mixer temperature of 40° C. for 3 minutes, to give a mixture. The resulting mixture was melt-kneaded at 100° C. with a continuous twin-screw kneader, to give a kneaded product. The kneaded product was then cooled in the air, roughly pulverized and finely pulverized. Thereafter, the resulting product was classified, to give a black powder having a volume-average particle size of 8.5 $\mu$m.

The amount 1000 g of the resulting powder and 8 g of a hydrophobic silica "AEROSIL R-972" (commercially available from Nippon Aerosil, average particle size: 16 nm) were mixed with stirring for 3 minutes with a Henschel mixer, to give a black toner.

Example 2

The same procedures were carried out as in Example 1 except that the colorant was changed to 700 g of "Dye Pyroxide Black No. 1" (commercially available from DAINICHISEIKA COLOR & CHEMICALS MFG. CO., LTD.), to give a black toner.

Example 3

The same procedures were carried out as in Example 1 except that the colorant was changed to 700 g of "MC-6" (commercially available from MITSUI MINING & SMELTING CO., LTD.), to give a black toner.

Example 4

The same procedures were carried out as in Example 1 except that the colorant was changed to 700 g of "HSB-605" (commercially available from Toda Kogyo Corp.), to give a black toner.

Example 5

The same procedures were carried out as in Example 1 except that the colorant was changed to 700 g of "ETB-100" (commercially available from Titan Kogyo K.K.), to give a black toner.

Example 6

The same procedures were carried out as in Example 1 except that Resin A was changed to 7000 g of a styrene(St)-butyl acrylate(BA)-methyl methacrylate(MMA) copolymer resin (weight-average molecular weight: 130,000, St/BA/MMA (molar ratio): 82.0/16.5/1.5), to give a black toner.

Example 7

A monomer mixture comprising 60 parts by weight of styrene, 40 parts by weight of butyl acrylate and 8 parts by weight of acrylic acid was added to an aqueous mixed solution comprising 100 parts by weight of water, 1 part by weight of a nonionic emulsifier "EMULGEN 950" (commercially available from Kao Corporation), 1.5 parts by weight of an anionic emulsifier "Neogen R" (commercially available from DAI-ICHI KOGYO SEIYAKU CO., LTD.) and 0.5 parts by weight of potassium persulfate, and polymerized with stirring at 70° C. for 8 hours, to give a resin emulsion containing an acidic, polar group, the resin emulsion having a solid ingredient of 50% by weight. The resin contained in the emulsion had a glass transition point of 55° C., a gelation degree of 5% and a softening point of 148° C.

A mixture of 120 parts by weight of the resulting resin emulsion containing an acidic, polar group, 2 parts by weight of a charge control agent "BONTRON S-34" (commercially available from Orient Chemical Co., Ltd.), 10 parts by weight of a colorant "Dye Pyroxide Black No. 2" (commercially available from DAINICHISEIKA COLOR & CHEMICALS MFG. CO., LTD.) and 380 parts by weight of water was kept at about 30° C. for 2 hours with dispersing and stirring with a slusher. Thereafter, with stirring, the mixture was further heated to 70° C. and kept at 70° C. for 3 hours. During this time, it was confirmed by a microscopic observation that a complex of the resin particles and the colorant particles was grown to a size of about 7 gm. After cooling, the resulting liquid dispersion was filtered through a Buchner funnel, washed with water and vacuum-dried at 50° C. for 10 hours, to give a powder having an average particle size of 9.5 $\mu$m.

One-hundred parts by weight of the resulting powder and 0.8 parts by weight of a hydrophobic silica "AEROSIL R-972" (commercially available from Nippon Aerosil, average particle size: 16 nm) were mixed with stirring for 3 minutes with a Henschel mixer, to give a black toner.

Example 8

The same procedures were carried out as in Example 1 except that Resin A was changed to 7000 g of Resin B, to give a black toner.

Example 9

The same procedures were carried out as in Example 1 except that the colorant was changed to 700 g of "MC-10" (commercially available from MITSUI MINING & SMELTING CO., LTD.), to give a black toner.

Comparative Example 1

The same procedures were carried out as in Example 1 except that the colorant was changed to 700 g of "HSB-603" (commercially available from Toda Kogyo Corp.), to give a black toner.

Comparative Example 2

The same procedures were carried out as in Example 1 except that the colorant was changed to 350 g of a carbon black, "Regal 300R" (commercially available from Cabot Corporation), to give a black toner.

Comparative Example 3

The amount 7000 g of a styrene-acrylic copolymer resin (Mw=183000, Mn=8200, glass transition point: 59° C.), 350 g of a carbon black "MA#8" (commercially available from MITSUBISHI CHEMICAL INDUSTRIES, LTD.), 420 g of cupric oxide (commercially available from Wako Pure Chemical Industries, oil absorption: 15 cc/g, average particle size: 4.0 $\mu$m), 280 g of a charge control agent "BONTRON S-34" (commercially available from Orient Chemical Co., Ltd.) and 210 g of a polypropylene wax "Viscol 330P" (commercially available from SANYO CHEMICAL INDUSTRIES, LTD.) were supplied into a Henschel Mixer, and mixed with stirring at a mixer temperature of 40° C. for 3 minutes, to give a mixture. The resulting mixture was melt-kneaded at 100° C. with a continuous twin-screw kneader, to give a kneaded product. The kneaded product was then cooled in the air, roughly pulverized and finely pulverized. Thereafter, the resulting product was classified, to give a black powder having a volume-average particle size of 12.0 $\mu$m.

The amount 1000 g of the resulting powder and 3 g of a hydrophobic silica "AEROSIL R-972" (commercially available from Nippon Aerosil, average particle size: 16 nm) were mixed under stirring for 3 minutes with a Henschel mixer, to give a black toner.

Comparative Example 4

The same procedures were carried out as in Example 1 except that Resin A was changed to 7000 g of Resin B, and that the colorant was changed to 350 g of a carbon black, "Regal 300R" (commercially available from Cabot Corporation), to give a black toner.

The properties of the composite oxide used in each of Examples 1 to 9 and Comparative Example 1 are shown in Table 1.

TABLE 1

| Composite Oxide | Average Particle Size ($\mu$m) | Oil Absorption [A] (ml/100 g) | Specific Surface Area [B] ($m^2$/100 g) | [A]/[B] (ml/$m^2$) | Major Metal Constituent |
|---|---|---|---|---|---|
| Dye Pyroxide Black No. 1 | 0.1 | 35 | 2840 | 0.0123 | Fe, Mn, Cu |
| Dye Pyroxide Black No. 2 | 0.01 | 22 | 5600 | 0.0039 | Fe, Mn, Cu |
| ETB-100 | 0.25 | 30 | 480 | 0.0625 | Ti, Fe |
| MC-6 | 0.02 | 93 | 6940 | 0.0134 | Fe, Mn |
| HSB-605 | 0.15 | 18 | 600 | 0.0300 | Fe, Mn |
| HSB-603 | 0.3 | 21 | 270 | 0.0778 | Fe, Mn |
| MC-10 | 0.1 | 51 | 4160 | 0.0123 | Mg, Al, Fe |

Test Example 1

[Evaluation of Transferability of Toner]

Each of the black toners obtained in Examples excluding Example 8 and Comparative Example 4, namely Examples 1 to 7 and 9 and Comparative Examples 1 to 3 was loaded onto a nonmagnetic, monocomponent laser printer for reversal development "Microline 703n" (commercially available from Oki Data Corporation). After printing 50 sheets of an original having blackened ratio of 5%, solid image printing was carried out. The electric source of the printer was turned off during the solid image printing, and the toner remaining on the photoconductor after transferring solid image was collected with a mending tape (commercially available from SUMITOMO 3M LIMITED, Cat. No. 810-3-18). The degree of whiteness (ΔY) of the mending tape pasted on plain copy paper relative to blank was determined, and the transferability of the solid image was evaluated by the following evaluation criteria.

In addition, the transferability of solid images was evaluated in the same manner as above except for carrying out the life-end test by printing of an original having blackened ratio of 5% for 30000 sheets.

Further, the transferability of thin line image was visually observed after subjecting to printing test of an original having blacked ratio of 5% for 50 sheets or 30000 sheets, and evaluated by the following evaluation criteria. The results are shown in Table 2.

[Evaluation Criteria for Transferability of Solid Image]

◎: ΔY is less than 1, and the transferability is especially excellent for practical use.

○: ΔY is 1 or more and less than 2, and the transferability is excellent for practical use.

Δ: ΔY is 2 or more and less than 5, and the transferability is at the minimal level for practical use.

x: ΔY is 5 or more, and the transferability is not desirable for practical use.

[Evaluation Criteria for Transferability of Thin Line Image]

◎: Thin line is reliably reproduced, and the transferability is especially excellent for practical use.

○: Thin line is reproduced, and the transferability is excellent for practical use.

Δ: Thin line is reproduced to some extent, and the transferability is at the minimal level for practical use x: Thin line is poorly reproduced, and the transferability has a problem in practical use.

Test Example 2

Each of the black toners obtained in Example 8 and Comparative Example 4 was loaded on a black color development in a full-color nonmagnetic, monocomponent laser printer for reversal development "QMS MAZICOLOR2" (commercially available from QMS). The transferability of the solid image and the thin line image was evaluated in the same manner as in Test Example 1, except for making the life-end at 6000 sheets. Here, the printing paper was a paper commercially available as "XEROX 4200." The results are shown in Table 2.

TABLE 2

| | | Transferability of Fixed Image at Start (50 sheets) | | Transferability of Fixed Image at Life-End | |
|---|---|---|---|---|---|
| | Colorant | Solid Image | Thin Line Image | Solid Image | Thin Line Image |
| Example 1 | Dye Pyroxide Black No. 2 | ◎ | ◎ | ◎ (0.33) | ◎ |
| Example 2 | Dye Pyroxide Black No. 1 | ◎ | ◎ | ◎ (0.68) | ◎ |
| Example 3 | MC-6 | ◎ | ◎ | ◎ (0.79) | ○ |
| Example 4 | HSB-605 | ◎ | ◎ | ○ (1.91) | Δ |
| Example 5 | ETB-100 | ◎ | ◎ | Δ (4.52) | Δ |
| Example 6 | Dye Pyroxide Black No. 2 | ◎ | ◎ | ◎ (0.88) | ○ |
| Example 7 | Dye Pyroxide Black No. 2 | ◎ | ◎ | ◎ (0.45) | ◎ |
| Example 8 | Dye Pyroxide Black No. 2 | ◎ | ◎ | ◎ (0.67) | ◎ |
| Example 9 | MC-10 | ◎ | ◎ | ◎ (0.32) | ◎ |
| Comparative Example 1 | HSB-603 | ◎ | ◎ | x (5.70) | x |
| Comparative Example 2 | Carbon Black | ◎ | ◎ | x (6.97) | x |
| Comparative Example 3 | Carbon Black | ◎ | ◎ | x (8.45) | x |
| Comparative Example 4 | Carbon Black | ◎ | ◎ | x (8.56) | x |

Example 10

The same procedures as in Example 9 are carried out except for using 7000 g of a resin prepared according to the method described in Example 1 of Japanese Patent Laid-Open No. Hei 10-87839 (U.S. Pat. No. 5,908,727), a hybrid resin in place of Resin A, and not using the polypropylene wax, to give a black toner. Further, in a case where the transferability of the black toner is evaluated in the same manner as in Test Example 1, both the solid image and the thin line image have the transferability on a practically usable level even after durability printing test as in the black toner of Example 9.

It is seen from the above results that the toners of Examples can maintain the transferability on a practically usable level even after durability printing for both solid image and thin line image, especially when the oil absorption of the composite oxide contained as a colorant is small, regardless of the processes for preparing the resin or the toner. On the other hand, all of the toners of Comparative Examples, including the toner of Comparative Example 1 which comprises a composite oxide having an oil absorption higher than the given value, and the toners of Comparative Examples 2 to 4 containing carbon black, showed drastically lowered transferability after the durability test.

According to the present invention, there is provided a nonmagnetic black toner for reversal development, comprising a black colorant useful for reversal development, namely a nonmagnetic black toner for reversal development for performing area coverage modulation by halftone, which has a sufficient high degree of blackness, a high volume-specific resistance, and excellent image transferability.

What is claimed is:

1. A process for development of a toner, comprising applying a nonmagnetic black toner to a development device for reversal development, wherein the nonmagnetic black toner comprises:

a resin binder; and a black colorant comprising a composite oxide of two or more metals, the composite oxide having an oil absorption per unit area of 0.07 $ml/m^2$ or less.

2. The process according to claim 1, herein at least one metal constituting the composite oxide belong to Group 2 or 13 of the Third Period or Groups 3 to 11 of the Fourth Period of the Periodic Table.

3. The process according to claim 1, herein the composite oxide has an average particle size of 5 nm to 1 $\mu$m.

4. The process according to claim 1, wherein the composite oxide is contained in an amount of 4 to 30% weight of the toner.

5. The process according to claim 1, wherein the resin binder comprises 50 to 100% by weight of a polyester.

6. The process according to claim 1, wherein the toner is a pulverized toner.

7. The process according to claim 1, wherein the development device is a device for nonmagnetic monocomponent development.

8. The process according to claim 1, wherein the development device is a device for full-color development.

* * * * *